US008358786B2

(12) United States Patent
Arora

(10) Patent No.: US 8,358,786 B2
(45) Date of Patent: Jan. 22, 2013

(54) METHOD AND APPARATUS TO MEASURE HEARING ABILITY OF USER OF MOBILE DEVICE

(75) Inventor: Manish Arora, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 562 days.

(21) Appl. No.: 12/429,253

(22) Filed: Apr. 24, 2009

(65) Prior Publication Data

US 2009/0268919 A1 Oct. 29, 2009

Related U.S. Application Data

(60) Provisional application No. 61/047,865, filed on Apr. 25, 2008.

(30) Foreign Application Priority Data

Sep. 3, 2008 (KR) ..... 10-2008-0086708

(51) Int. Cl.
*H04R 29/00* (2006.01)

(52) U.S. Cl. ..... 381/56; 381/72; 381/104

(58) Field of Classification Search ..... 381/56, 381/57, 58, 72, 104; 455/550.1
See application file for complete search history.

(56) References Cited

U.S. PATENT DOCUMENTS

| | | | | |
|---|---|---|---|---|
| 7,756,280 | B2 | 7/2010 | Hsieh et al. | |
| 8,059,833 | B2 | 11/2011 | Koh et al. | |
| 2003/0078515 | A1* | 4/2003 | Menzel et al. | 600/559 |
| 2003/0083591 | A1* | 5/2003 | Edwards et al. | 600/559 |
| 2005/0124375 | A1* | 6/2005 | Nowosielski | 455/550.1 |
| 2006/0045281 | A1* | 3/2006 | Korneluk et al. | 381/60 |
| 2007/0076895 | A1 | 4/2007 | Li et al. | |
| 2007/0078648 | A1 | 4/2007 | Li et al. | |
| 2007/0116296 | A1 | 5/2007 | Hsieh et al. | |
| 2007/0129828 | A1 | 6/2007 | Lee et al. | |
| 2007/0195969 | A1 | 8/2007 | Ding et al. | |
| 2007/0195970 | A1 | 8/2007 | Ding et al. | |
| 2007/0204694 | A1 | 9/2007 | Davis | |
| 2007/0253571 | A1 | 11/2007 | Li et al. | |
| 2007/0253572 | A1 | 11/2007 | Li et al. | |
| 2008/0254753 | A1* | 10/2008 | Steenstra et al. | 455/90.1 |

FOREIGN PATENT DOCUMENTS

| | | | |
|---|---|---|---|
| KR | 20050109323 | | 11/2005 |
| KR | 1020060075134 | | 7/2006 |
| WO | WO 03/077511 | * | 9/2003 |
| WO | 2006/068345 | | 6/2006 |

* cited by examiner

*Primary Examiner* — Minh-Loan T Tran

*Assistant Examiner* — Fazli Erdem

(74) *Attorney, Agent, or Firm* — Stanzione & Kim, LLP

(57) ABSTRACT

Provided are a method and apparatus to measure in real time the hearing ability of a user in a game environment of a mobile device. The method includes generating a series of sound patterns and visual patterns for a combination of a specific frequency and level of sound, and extracting ear characteristics of the user based on the user's responses to the series of sound patterns and visual patterns.

19 Claims, 4 Drawing Sheets

METHOD AND APPARATUS TO MEASURE HEARING ABILITY OF USER OF MOBILE DEVICE

CROSS-REFERENCE TO RELATED APPLICATIONS

This application claims priority under 35 USC §119 and 35 USC §120 from U.S. Provisional Application No. 61/047,865 filed on 25 Apr. 2008 in the U.S. Patent and Trademark Office and from Korean Patent Application No. 10-2008-0086708, filed on Sep. 3, 2008, in the Korean Intellectual Property Office, the disclosures of which are incorporated herein in their entirety by reference.

BACKGROUND

1. Field of the General Inventive Concept

The present general inventive concept relates to a method and apparatus to measure hearing ability of a user of a mobile device, and also, to a method and apparatus to measure in real time ear characteristics of a user in an environment of a mobile device.

2. Description of the Related Art

According to recent surveys, one in ten people suffer from hearing loss that could affect the normal perception of voices, music, or other sounds. Although rapid industrialization has improved standards of living, it has also led to increased noise and environmental contamination that can cause hearing loss.

Most people seldom notice their hearing loss. As people tend to not notice their acoustic environment, they are exposed to factors that can cause hearing loss, without taking any protection measures.

In recent years the use of mobile multimedia appliances such as portable FM radios, mp3 players and portable music players (PMPs) has dramatically increased. These appliances provide straightforward access to music, moving pictures and audio signals. These mobile devices can adopt various forms of entertainment and useful applications. In addition, the designs of chips and the durability of batteries have improved sound quality and playback time. It is also possible to listen to music at a high volume by using earphones and other audio receiving devices, without interrupting other people. However, exposure to high sound energy may cause many users to experience hearing loss.

Therefore, there is a need for mobile devices that can inform the user of his/her current hearing ability by measuring the hearing ability, as well as providing optimal sound quality according to the ear frequency characteristics of the user.

Conventional methods of measuring the hearing ability of a user involve reproducing an audio signal and inquiring whether the user can hear the audio signal or not. However, these limited conventional methods do not provide the user any interest or motivation to repeat or continue hearing ability measurements.

SUMMARY

The present general inventive concept provides a method and apparatus to measure hearing ability of a user in a mobile device, in which ear frequency characteristics of the user are extracted based on the user's responses to a series of visual patterns and sound patterns.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of measuring the hearing ability of a user of a mobile device, the method including generating a series of sound patterns and visual patterns for a combination of a specific frequency and level of sound, and extracting ear characteristics of the user based on the user's responses to the series of sound patterns and visual patterns.

Extracting of the ear characteristics of the user may include extracting an audible frequency and level of sound heard by the user based on the user's responses to the series of sound patterns and visual patterns.

Extracting of the ear characteristics of the user may include determining whether the user can hear the specific frequency and level of sound, based on results of analyzing user inputs in response to the series of sound patterns and visual patterns.

Extracting of the ear characteristics of the user may include storing user inputs in response to the series of sound patterns and visual patterns, determining whether a user's action is appropriate by averaging the user inputs, and determining whether the specific frequency and level of sound are audible, based on results of determining whether the user's action is appropriate. User inputs are a predetermined number of user's actions. The determining of whether the specific frequency and level of sound are audible may include updating the specific frequency and level of sound as an audible frequency and level of sound if a predetermined number of user inputs is within an allowable range, and updating the specific frequency and level of sound as a non-audible frequency and level of sound if the predetermined number of user's inputs is outside the allowable range.

Extracting of the ear characteristics of the user may be repeatedly performed on a predetermined range of frequencies and levels of sound. Sound patterns may be a natural sound having a predetermined pattern.

Extracting of the ear characteristics of the user may include displaying measurement results if the measurement of acoustic characteristics based on the combination of the specific frequency and level of sound has been completed, and comparing the results of the measurement and expected results.

The visual patterns may be displayed on a screen, and the audio patterns may be output to a speaker unit. The visual patterns and the sound patterns may be generated in a game environment in a mobile device.

The foregoing and/or other aspects and utilities of the present general inventive concept may also be achieved by providing an apparatus to measure the hearing ability of a user of a mobile device, the apparatus including a user input unit to receive the user's actions in response to a series of sound patterns and visual patterns, a sound engine unit to generate an audio signal that corresponds to the sound patterns, a graphics engine unit to generate a graphics signal that corresponds to the visual patterns.

The user input unit may be either a button interface or a touch screen. A volume control unit may control the volume of the audio signal generated in the sound engine unit.

The user input unit may include a voice input unit. The voice input unit may include voice or sound recognition programs.

The foregoing and/or other aspects and utilities of the present general inventive concept may also be achieved by providing a mobile device including a user input unit to receive a user's actions in response to a series of sound patterns and visual patterns, a sound engine unit to generate an audio signal that corresponds to the sound patterns, a graphics engine unit to generate a graphics signal that corresponds to the visual patterns, a display unit to display the graphics signal generated in the graphics engine unit, an audio output unit to output the audio signal generated in the sound engine unit, and a control unit to generate the series of sound patterns and visual patterns for a combination of a specific frequency and level of sound, and to extract ear characteristics of the user based on the user's actions input to the user input unit in response to the audio signal output to the audio output unit and the graphics signal displayed on the display unit. A graphics post-processing unit may post-process the graphics signal generated in the graphics engine unit according to a display format of the display unit.

A control unit may generate the series of sound patterns and visual patterns for a combination of a specific frequency and level of sound, and may extract ear characteristics of the user based on the user's actions input to the user input unit in response to the audio signal generated in the sound engine unit and the graphics signal generated in the graphics engine unit.

The user's actions may be a user's responses to correspond to the generated sound patterns. The user's actions may also correspond to the user's responses to generate user information or to adjust a next sound of the mobile device.

The foregoing and/or other aspects and utilities of the present general inventive concept may also be achieved by providing a computer readable recording medium having embodied thereon a computer program to execute a method to measure the hearing ability of a user of a mobile device, the method including generating a series of sound patterns and visual patterns for a combination of a specific frequency and level of sound, and extracting ear characteristics of the user based on the user's responses to the series of sound patterns and visual patterns.

The foregoing and/or other aspects and utilities of the present general inventive concept may also be achieved by providing an apparatus of a mobile device, including a control unit configured to generate a series of sound patterns and visual patterns for a combination of a specific frequency and level of sound and to extract ear characteristics of the user based on the user's responses to the series of sound patterns and visual patterns.

The apparatus may include an audio output unit to generate sound corresponding to sound patterns. The apparatus may include an earphone connected to the control unit to generate sound corresponding to the sound data. The apparatus may include a user input unit to receive a user response to correspond to the generated sound patterns. The control unit may generate data to correspond to the user's responses to generate user information or to adjust a next sound of the mobile device.

An apparatus of a mobile device including a control unit configured to generate data to correspond to a user's responses to generate user information or to adjust a sound of the mobile device.

A method of measuring the hearing ability of a user of a mobile device, the method including generating a plurality of sound patterns and visual patterns to output to a user, and extracting left and right ear characteristics of a user in a diagnostic test mode.

A method of measuring the hearing acuity of a user of a mobile terminal, the method including generating a series of sound patterns and visual patterns for a plurality of combinations of specific frequencies and levels of sound to output to a user, and comparing the user's actions when the user can hear sound and the user's actions when the user cannot hear sound.

A method of measuring the hearing ability of a user of a mobile device, the method including receiving the user's actions in response to a series of sound patterns and visual patterns, generating an audio signal that corresponds to the sound patterns, generating a graphics signal that corresponds to the visual patterns, and generating the series of sound patterns and visual patterns for a combination of a specific frequency and level of sound and extracting ear characteristics of the user based on the user's actions input to the user input unit in response to the audio signal generated in the sound engine unit and the graphics signal generated in the graphics engine unit.

An apparatus to measure the hearing ability of a user of a mobile device, the apparatus including a housing, a user input unit disposed on the housing to receive the user's actions in response to a series of sound patterns and visual patterns, and a control unit disposed in the housing to generate a series of sound patterns and visual patterns for a combination of specific frequencies and levels of sound, wherein the control unit extracts ear characteristics of the user based on the user's actions input to the user input unit.

The control unit may compare the user's actions when the user can hear sound and the user's actions when the user cannot hear sound. The user input unit may include a voice input unit. The voice input unit may include voice or sound recognition programs.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1:
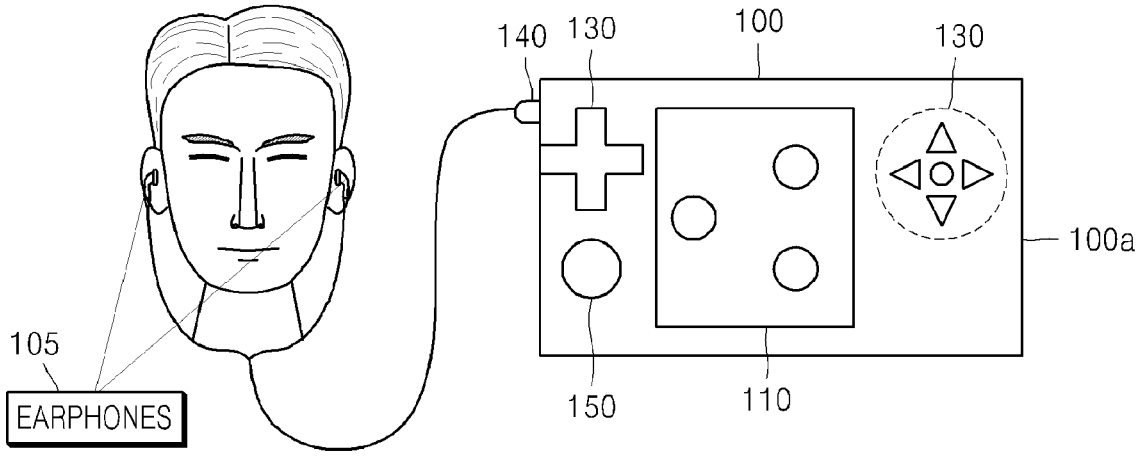
FIG. 1 is a conceptual view illustrating a hearing test performed on a user of a mobile device according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a conceptual view illustrating a hearing test of a user of a mobile device 100 according to the present general inventive concept.

Referring to FIG. 1, the hearing ability of a user can be measured by using the mobile device 100 and earphones 105 that are connected to the mobile device 100.

The mobile device 100 includes a display unit 110, a plurality of user input units 130, and an audio output unit 140.

The display unit 110 may also be used as a user input unit in the form of a touch screen. The touch screen may be activated by contact with a portion of the user's body, or with an implement such as stylus or other tool to manipulate the device. A user may also input responses to visual and sound patterns via the voice of the user, through a voice input unit 150, such as a microphone. The mobile device 100 may generate a series of sound patterns and visual patterns for a combination of a specific frequency and level of sound. The display unit 110 may display information on visual patterns combined with sound patterns in a game environment, during playback, or in a test mode. The visual patterns may be displayed on a screen, and the sound patterns may be output to a speaker unit, which may connect to earphones, headphones, or other audio reproduction devices. The mobile device 100 may have a housing 100*a* in which the above described elements are formed as a single body.

While the user has the earphones in his/her ear, the user may perform cognition actions using the user input units 130 whenever graphics and/or sounds are output to the display unit 110 of the mobile device 100 and the earphones, respectively. Cognition actions include user commands entered via the user inputs 130, the touch screen 110, and the microphone 150 unit. The mobile device 100 measures the ear characteristics of the user by interpreting these and other cognition actions of the user. Here, the mobile device 100 extracts ear characteristics of the user based on the user's responses to the sound patterns and the visual patterns.

Therefore, the mobile device 100 receives the user's inputs via actions based on graphics and sound information and can evaluate whether the user can hear a specific level of sound based on the interpretation and timing of the user's inputs.

The mobile device 100 further includes a function unit thereof to perform a functional operation to generate signals corresponding to an image or sound through an image output unit or an audio output unit. The mobile device 100 may be an audio device such as a wireless phone, a gaming device, a PDA, MP3 player, portable computer, or the like.

Figure 2:
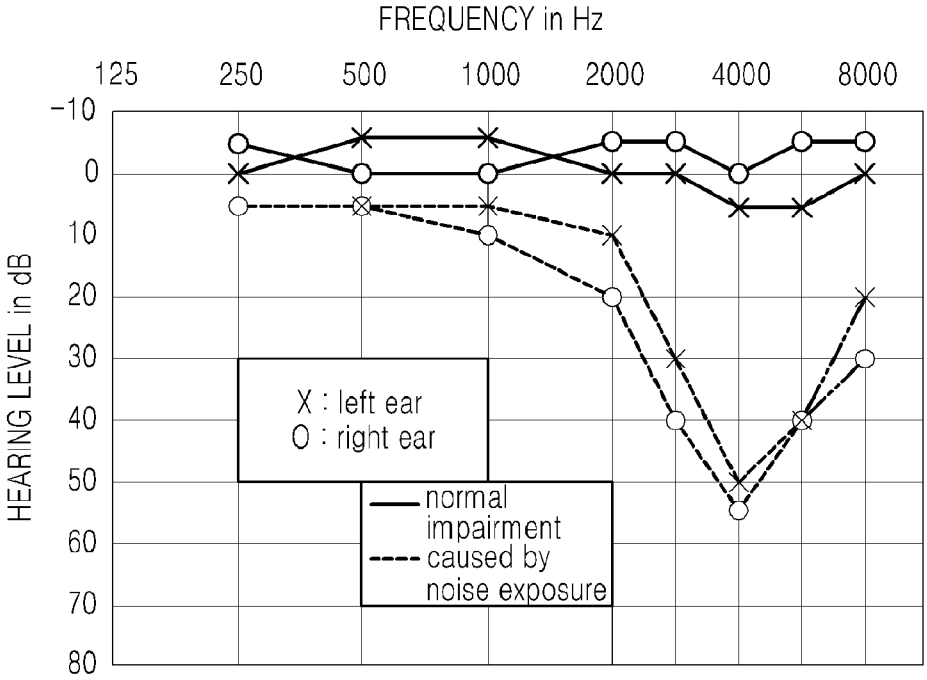
FIG. 2 is a graph illustrating ear frequency characteristics of the user resulting from the hearing test in FIG. 1.

FIG. 2 is a graph of ear characteristics of the user, resulting from a hearing test that may be conducted by the mobile device 100 illustrated in FIG. 1.

A hearing threshold (HT), which is the lowest level of audible sound, and an uncomfortable hearing level (UCL) that causes pain to the ear and hearing problems vary according to different users and are measured and distributed according to frequencies. An audiogram may represent the degree of deafness, for example hearing level in dB, of a person as a function of frequency. A result of the audiogram that is "0" dB indicates that a user's hearing threshold is normal, as represented by equal loudness curves. In addition, a result of the audiogram that is above "0" dB may indicate degrees of deafness resulting from the different hearing abilities of a person. Referring to FIG. 2, solid lines represent an example of audiograms of normal hearing, and the dotted lines represent the audiograms of abnormal hearing caused by exposure to noise. The noise may be an undesired noise. FIG. 2 illustrates that someone with normal hearing may have varying hearing levels of different frequencies in a left ear and a right ear. However, in the aggregate, a person with normal hearing will average close to the 0 dB range. The audiogram as in FIG. 2 may be measured based on a user's cognition responses to sound patterns and visual patterns in interacting with the mobile device 100. FIG. 2 illustrates that at lower frequencies, in the range of 1000 Hz or lower, undesired noise may have a negative effect on the hearing of a user, but at higher frequency ranges, for example, above 2000 Hz, the hearing impairment of an average user is much more pronounced.

A level of audiograms of normal hearing (solid line) can be changed to a level of audiograms of abnormal hearing (dotted line) due to noise. Therefore, the hearing levels represented by the solid and dotted lines are adjusted or changed by a level corresponding to the noise of a corresponding frequency.

Figure 3:
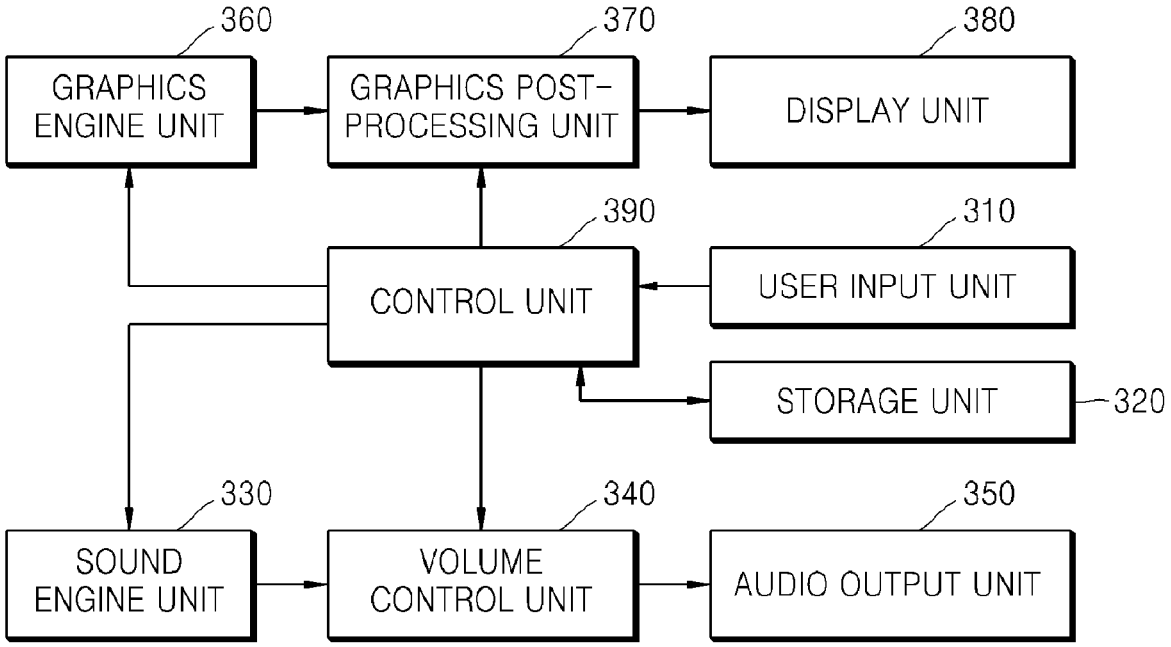
FIG. 3 is a block diagram illustrating an apparatus to measure the hearing ability of a user of a mobile device according to an embodiment of the present general inventive concept.

FIG. 3 is a block diagram of an apparatus to measure the hearing ability of a user of a mobile device according to an embodiment of the present general inventive concept.

The apparatus to measure the hearing ability of a user illustrated FIG. 3 may include a user input unit 310, a storage or memory unit 320, a sound engine unit 330, a volume control unit 340, an audio output unit 350, a graphics engine unit 360, a graphics post-processing unit 370, a display unit 380, and a control unit 390.

Using a button interface, touch screen, or microphone, the user input unit 310 may receive a user's actions in response to a series of sound patterns output by the audio output unit 350 and visual patterns displayed by the display unit 380.

The storage unit 320 may store one or more hearing test programs, cognition interpretation programs, user response programs, graphical response programs, sound/voice recognition software, hearing test sounds and graphics, user inputs, hearing test results, ear frequency response curves, and the like.

The sound engine unit 330 may generate left and right ear audio signals that corresponds to sound patterns generated in the control unit 390. The volume control unit 340 may control the volume of the audio signals generated in the sound engine unit 330. The audio output unit 350 may output the audio signals that are output from the volume control unit 340.

The graphics engine unit 360 may generate a graphics signal that corresponds to the visual patterns generated in the control unit 390. The graphics post-processing unit 370 may perform a post-processing operation on the graphics signal that is generated in the graphics engine unit 360, according to a display format of the display unit 380. The display unit 380 may display the graphics signal processed in the graphics post-processing unit 370 or the hearing test results, etc. The display unit 380 may include a liquid crystal display (LCD) or electroluminescent (EL) display in an embodiment of the present general inventive concept.

The control unit 390 may generate a series of sound patterns and visual patterns for a combination of a specific frequency and level of sound and may simultaneously output audio signals and graphics signals that correspond to the series of sound patterns and visual patterns to the sound engine unit 330 and the graphics engine unit 360, respectively. The control unit 390 may also extract and measure acoustic characteristics corresponding to the audible frequency and levels of sound based on the user's responses to the series of sound patterns and visual pattern. The user's responses can be input to a control unit 390 through the user input unit 310.

For example, when the user hears a certain sound corresponding to a frequency, at a certain level of sound, the user may enter a response to the input unit 310, and then the control unit 390 may determine the level (volume) and the frequency that correspond to the response entered by the user.

In addition, the control unit 390 interprets the user's responses input to the user input unit 310. For example, the control unit 390 compares the user's actions when the user can hear sound and the user's actions when the user cannot hear sound, in order to determine how acute is the user's sense of hearing at a specific frequency and level of sound.

The control unit 390 may generate data corresponding to the user responses. The data can be used to generate user information representing the user's hearing ability. The data may be used to generate or adjust sound according to original sound data and the generated user information.

Figure 4A:
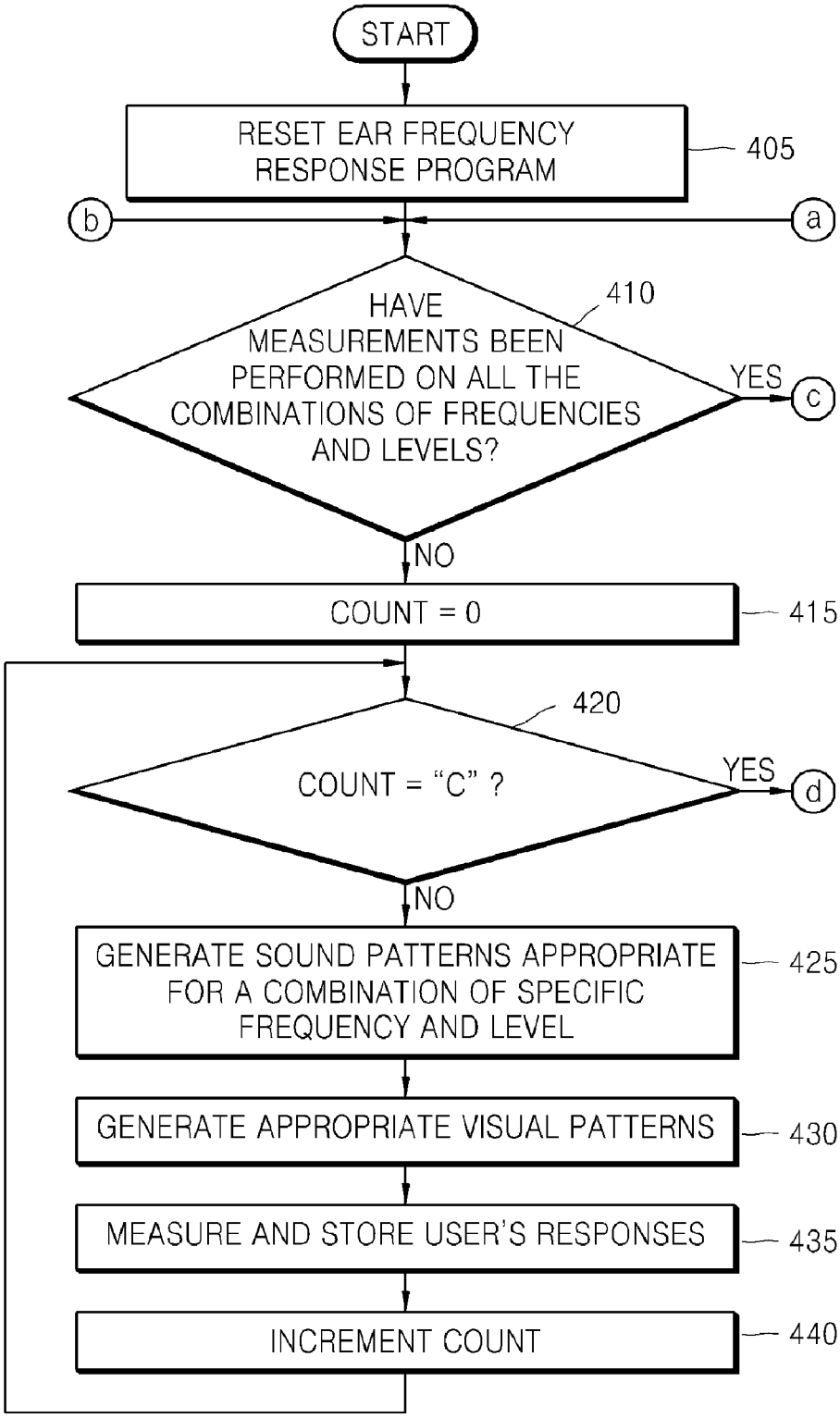
FIGS. 4A and 4B are a flowchart illustrating a method of measuring the hearing ability of a user of a mobile device according to an embodiment of the present general inventive concept.
Figure 4B:
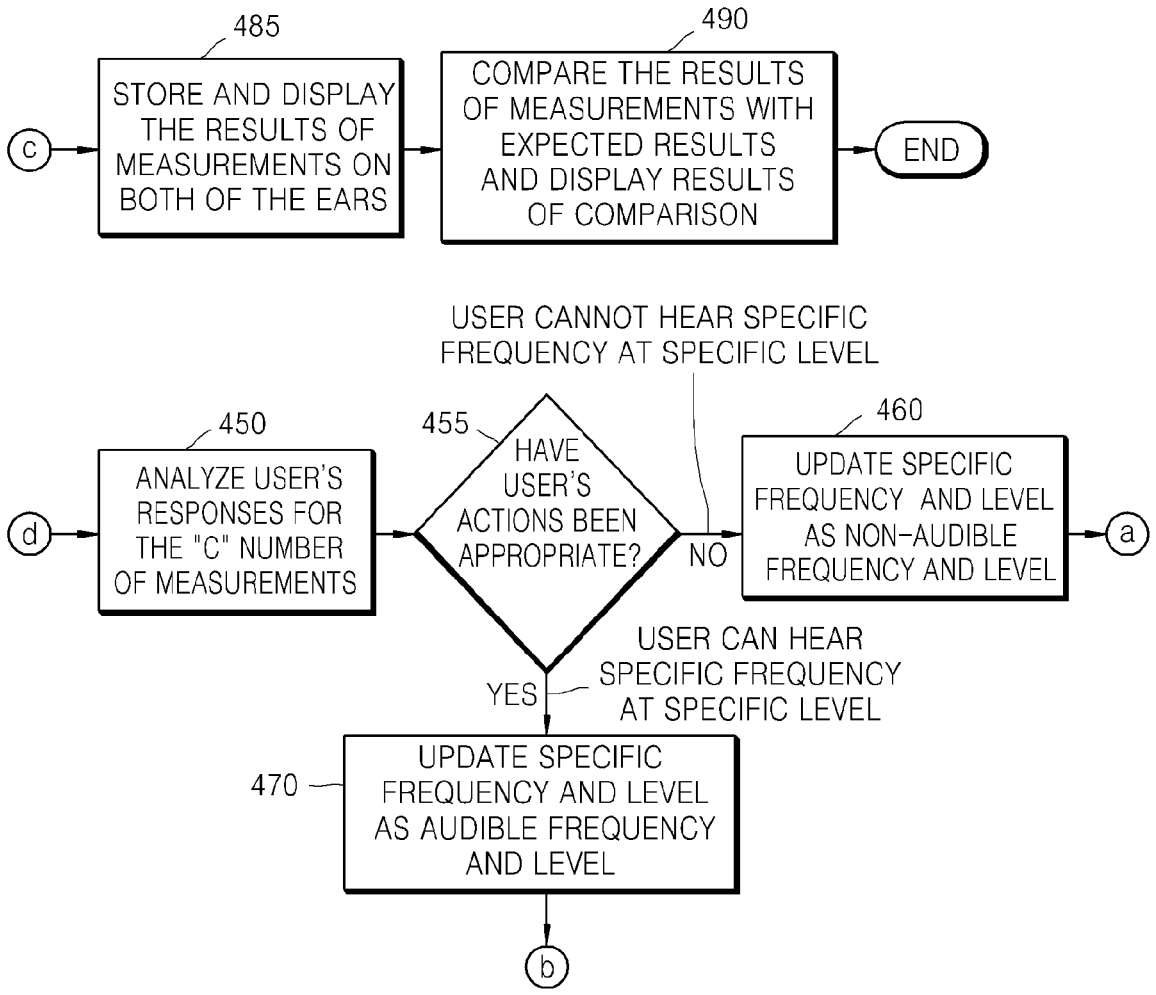

FIGS. 4A and 4B illustrate a method of measuring the hearing ability of a user of a mobile device according to an embodiment of the present general inventive concept.

Initially, as illustrated in FIG. 4A, an ear frequency response program may be set to an initialization state (operation 405). Next, hearing ability measurement of a user may be repeatedly performed until all the acoustic responses to a desired range of frequencies and levels of sound are measured. The range of frequencies and levels of sound, which are used for the hearing ability measurement, are predetermined.

The range of frequencies, which are used for the hearing ability measurement are from about 20 Hz to about 20 KHz. However, frequencies from about 100 Hz to about 16 KHz are sufficient in practice. In addition, the levels of sound, which are used for the hearing ability measurement, may be from a typical audible level of volume that can be perceived in a normal state of 0 dB to approximately 80 dB, which is outside the typical audible level of volume.

For example, if the frequencies and level of sound, which are used for the hearing ability measurement, include 7 frequencies and 15 levels of sound, respectively, the number of possible hearing ability measurements may be one hundred and five, 105 (=7×15), in total. For the frequencies and levels of sound, which are used for the hearing ability measurement, it is common that the frequencies are quantized into several bins and the levels of sound are quantized into 10 dB or 5 dB steps. Therefore, the hearing ability measurement of a user may be repeatedly performed for each of the combinations of specific frequencies and levels of sound using an electronic game simulation as described herein.

It is checked whether measurements have been performed on all the combinations of frequencies and levels of sound (operation 410). If measurements of user responses have not been performed on all the combinations (NO), a measurement count value (COUNT), which is the number of sets of measurements, is initialized to "0" (operation 415). Next, COUNT may be checked to determine whether the measurement count value equals a constant "C" (operation 420). Here, the constant "C" is a predetermined and preset measurement value that represents the number of times a set of all of the combinations of specific frequencies and levels of sound of have been performed.

If the count value is not equal to "C", sound patterns and visual patterns that are appropriate for a combination of the specific frequencies and levels of sound are generated (operations 425 and 430). That is, visual patterns and sound patterns that are part of a game environment, wherein the user is requested to take actions, are generated. Visual and sound patterns may also be generated in a diagnostic mode.

For example, a set of balls may be displayed in a game, which move according to a predetermined sound pattern. Some of the balls may move with an exact match to the sound pattern. Some of the balls move independently of the sound pattern. If a player can hear the sound, the player can see which ball moves according to the sound pattern. Therefore, if the user can hear the sound, the user can select a ball which moves according to the sound pattern. The sounds may be generated to play in one ear at a time, or both ears simultaneously, to accurately determine the ear characteristics of each ear.

In other words, if the user makes a mistake in selecting balls, it is determined that the user cannot accurately hear the sound that corresponds to the moving balls, and thus made a mistake in selecting balls. Therefore, it can be determined based on the user's responses to the combination of sound patterns and visual patterns whether the user can hear a specific sound.

The sound pattern may have no specific restriction. The sound pattern does not necessarily have to be a purely tonal signal. The sound pattern can be audio signals of a predetermined period that have specific frequencies and levels of sound, or can be natural sounds, such as the sound of birds or running water, of a predetermined period that have specific frequencies and levels of sound. Here, the visual pattern also has no specific restriction. For example, the visual pattern can be displayed as objects having a predetermined movement pattern, graphics or characters having a predetermined color pattern, and the like.

Next, the user inputs that represent the user's responses to the sound patterns and visual patterns are measured by the control unit 390 and stored in the storage unit 320 so that the left and right ear characteristics of the user can be extracted (operation 435). Here, the user inputs may be user's actions performed by manipulating either a button interface, a touch screen, or by a voice input, or other input.

Next, the count value (COUNT), which is the number of measurements, is incremented (operation 440), and the measurement count value may again be checked to determine whether the measurement count value equals "C" (operation 420).

In operation 420, if the measurement count value is equal to "C" (YES), then the number of user responses for the "C" number of sets of measurements are analyzed (operation 450), as illustrated in FIG. 4B. Here, "C" is a figure appropriate to an average of the results of user performance (user actions).

Measurement errors may occur due to a lack of user concentration or due to other user errors. However, since the results of user performance are averaged by the number of sets of measurements "C", the averaged result of the frequencies and levels of sound can be an index of the hearing ability of the user, indicating whether the user can perceive a specific sound, thus providing a more reliable test.

An appropriate value for "C" may be within the range of 3-7 iterations, which does not decrease pleasure factors in gaming. That is, a user will perform the hearing test "C" number of times before an actual game or other program will begin, so that the sound engine unit 330 may be used to adjust, if necessary, the volume being output by the volume control unit 340 to the left and right components of the audio output unit 350. Therefore, the "C" number of user responses is analyzed after being stored, in order to determine whether the user can hear a specific sound and frequency combination, in each ear individually, and together.

Referring to FIG. 4B, a determination may be made with reference to the "C" number of sets of measurements whether the user's response actions are appropriate (operation 455, YES). If a predetermined number of user responses (or user recognition actions) for each ear are within an allowable range, the user's actions are determined to be appropriate. Determining an allowable range may include a timing program to measure the time lapse of a program prompt to a user response action to that prompt. If the user's actions are determined to be appropriate, it is determined that the user can hear a specific frequency at a specific level of sound. The specific frequencies and levels of sound are characterized as being either audible or non-audible frequencies and levels of sound, based on the analysis results of the user inputs. Therefore, if the user's actions are determined to be appropriate for either or both ears, the specific frequency and level of sound are updated by the control unit 390 and stored in the storage unit 320 as an audible frequency and level of sound (operation 470). Then, as illustrated in FIG. 4A, it is again checked whether the measurements have been performed on all the combinations of frequencies and levels of sound (operation 410).

If the predetermined number of user responses (or user's recognition actions) for each ear are outside the allowable range, the user's actions are determined to be inappropriate. If the user's actions are determined to be inappropriate (operation 455, NO), it is determined that the user cannot hear a specific frequency at a specific level of sound (result 457). Therefore, if the user's actions are determined to be inappropriate for either or both ears, the specific frequency and level are updated as a non-audible frequency and level of sound (operation 460) by the control unit 390 and stored in the memory unit 320. Thereafter, it is again checked whether the measurements have been performed on all the combinations of frequencies and levels of sound (operation 410).

Next, if the left and right ear measurement characteristics of the user in response to all the combinations of frequencies and levels of sound have been measured (YES), the results of the hearing ability measurements on both of the ears are stored and displayed (operation 485), as illustrated in FIG. 4B. Then, in operation 490, the results of the hearing ability measurements are compared with expected results and the comparison results are displayed on the display unit 380. With the comparison results, the user may be prompted to manually adjust right ear and left ear sound levels to adjust the sound output from the mobile device 100 to be in accordance with the determined hearing levels. This adjustment may be done manually by the user, or the user may select an automatic adjustment function of the mobile device 100. Once the correct audio levels are set for a particular user within the mobile device 100, the user will enjoy more pleasing gaming activity, music playback, or other functions performed by the mobile device 100.

As described above, the hearing ability of a user can be measured by extracting the ear characteristics of the user in a game environment of a portable mobile device 100, while providing the user with interest and pleasure.

The present general inventive concept can also be embodied as computer readable codes on a computer readable medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc., and can be transmitted through carrier waves (such as data transmission through the Internet). The computer readable recording medium can also be distributed over network coupled computer systems so that the computer readable code is stored and executed in a distributed fashion.

While this present general inventive concept has been particularly illustrated and described with reference to exemplary embodiments thereof, it will be understood by those of ordinary skill in the art that various changes in form and details may be made therein without departing from the spirit and scope of the present general inventive concept as defined by the appended claims. The exemplary embodiments should be considered in a descriptive sense only and not for purposes of limitation. Therefore, the scope of the present general inventive concept is defined not by the detailed description of the present general inventive concept but by the appended claims, and all differences within the scope will be construed as being included in the present general inventive concept.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A method of measuring the hearing ability of a user of a mobile device, the method comprising:

generating a series of sound patterns and visual patterns by a control unit of the mobile device for a combination of specific frequencies and levels of sound;

extracting ear characteristics of the user by the control unit based on the user's responses to a combination of the sound patterns and visual patterns, the extracting of the ear characteristics of the user including:

storing user inputs in response to the series of sound patterns and visual patterns;

determining whether a user's action is appropriate by averaging the user inputs; and determining whether the specific frequency and level of sound are audible, based on results of determining whether the user's action is appropriate; and generating user information in the control unit based on the extracted ear characteristics.

2. The method of claim 1, wherein the extracting of the ear characteristics of the user comprises extracting an audible frequency and level of sound heard by the user based on the user's responses to the series of sound patterns and visual patterns.

3. The method of claim 1, wherein the extracting of the ear characteristics of the user comprises determining whether the user can hear the specific frequency and level of sound, based on results of analyzing user inputs in response to the series of sound patterns and visual patterns.

4. The method of claim 1, wherein the user inputs are a predetermined number of user's actions.

5. The method of claim 1, wherein the determining of whether the specific frequency and level of sound are audible comprises:

updating the specific frequency and level of sound as an audible frequency and level of sound if a predetermined number of user inputs is within an allowable range; and updating the specific frequency and level of sound as a non-audible frequency and level of sound if the predetermined number of user's inputs is outside the allowable range.

6. The method of claim 1, wherein the extracting of the ear characteristics of the user is repeatedly performed on a predetermined range of frequencies and levels of sound.

7. The method of claim 1, wherein the sound patterns are a natural sound having a predetermined pattern.

8. The method of claim 1, wherein the extracting of the ear characteristics of the user further comprises:

displaying measurement results if the measurement of acoustic characteristics based on the combination of the specific frequency and level of sound has been completed; and comparing the results of the measurement and expected results.

9. The method of claim 1, wherein the visual patterns are displayed on a screen, and the audio patterns are output to a speaker unit.

10. The method of claim 1, wherein the visual patterns and the sound patterns are generated in a game environment in a mobile device.

11. An apparatus to measure the hearing ability of a user of a mobile device, the apparatus comprising:

a user input unit to receive the user's actions in response to a series of sound patterns and visual patterns;

a sound engine unit to generate an audio signal that corresponds to the sound patterns;

a graphics engine unit to generate a graphics signal that corresponds to the visual patterns; and a control unit to generate the series of sound patterns and visual patterns for a combination of specific frequencies and levels of sound, and extract ear characteristics of the user based on the user's actions input to the user input unit in response to a combination of the audio signal generated in the sound engine unit and the graphics signal generated in the graphics engine unit, the control unit to store the user action's input in response to the series of sound patterns and visual patterns, to determine whether the user's actions input are appropriate by averaging the user actions that are input, and to determine whether the specific frequency and level of sound are audible, based on results of the determination of whether the user's actions are appropriate.

12. The apparatus of claim 11, wherein the user input unit is either a button interface or a touch screen.

13. The apparatus of claim 11, further comprising a volume control unit that controls the volume of the audio signal generated in the sound engine unit.

14. The apparatus of claim 11, wherein the user's actions are a user's responses to correspond to the generated sound patterns.

15. The apparatus of claim 11, wherein the user's actions correspond to the user's responses to generate user information or to adjust a next sound of the mobile device.

16. A non-transitory computer readable recording medium having embodied thereon a computer program to execute a method of measuring the hearing ability of a user of a mobile device, the method comprising:

generating a series of sound patterns and visual patterns by a control unit of the mobile device for a combination of specific frequencies and levels of sound;

extracting ear characteristics of the user by the control unit based on the user's responses to a combination of the sound patterns and visual patterns, the extracting of the ear characteristics of the user including:

storing user inputs in response to the series of sound patterns and visual patterns;

determining whether a user's action is appropriate by averaging the user inputs; and determining whether the specific frequency and level of sound are audible, based on results of determining whether the user's action is appropriate; and generating user information in the control unit based on the extracted ear characteristics.

17. The method of claim 1, further comprising:

adjusting a sound output from the mobile device according to original sound data and the generated user information.

18. The apparatus of claim 11, wherein the control unit further generates user information based on the extracted ear characteristics and adjusts a sound output from the mobile device according to original sound data and the generated user information.

19. The apparatus of claim 11, wherein the control unit obtains a plurality of sets of ear characteristics to obtain an average result of the frequencies and levels of sound to produce an index of the hearing ability of the user.

* * * * *